US010880669B2

(12) United States Patent
Sunder et al.

(10) Patent No.: US 10,880,669 B2
(45) Date of Patent: Dec. 29, 2020

(54) BINAURAL SOUND SOURCE LOCALIZATION

(71) Applicant: EmbodyVR, Inc., San Mateo, CA (US)

(72) Inventors: Kaushik Sunder, Mountain View, CA (US); Kapil Jain, Redwoood City, CA (US); Yuxiang Wang, Rochester, NY (US)

(73) Assignee: EmbodyVR, Inc., San Mateo, CA (US)

( * ) Notice: Subject to any disclaimer, the term of this patent is extended or adjusted under 35 U.S.C. 154(b) by 0 days.

(21) Appl. No.: 16/585,222

(22) Filed: Sep. 27, 2019

(65) Prior Publication Data

US 2020/0107149 A1 Apr. 2, 2020

Related U.S. Application Data

(60) Provisional application No. 62/738,517, filed on Sep. 28, 2018.

(51) Int. Cl.
*H04S 7/00* (2006.01)
*H04R 5/027* (2006.01)
(Continued)

(52) U.S. Cl.
CPC ..... *H04S 7/304* (2013.01); *H04R 1/406* (2013.01); *H04R 3/005* (2013.01); *H04R 5/027* (2013.01);
(Continued)

(58) Field of Classification Search
CPC .. H04S 7/304; H04S 2400/15; H04S 2420/01; H04R 1/406; H04R 3/005; H04R 5/027; H04R 5/033
(Continued)

(56) References Cited

U.S. PATENT DOCUMENTS 7,693,287 B2 * 4/2010 Eggert ..... G01S 3/8034 381/17
8,085,958 B1 * 12/2011 Trautmann ..... H04S 7/30 381/17
(Continued)

OTHER PUBLICATIONS

PCT Application Serial No. PCT/US2019/053391, International Search Report, dated Apr. 8, 2020, 3 pages.
(Continued)

*Primary Examiner* — Vivian C Chin
*Assistant Examiner* — Con P Tran
(74) *Attorney, Agent, or Firm* — Gilliam IP PLLC

(57) ABSTRACT

A first microphone on a first earpiece of a personal audio delivery device measures a first head related transfer function (HRTF) associated with a sound source. A second microphone on an earpiece of a personal audio delivery device measures a second HRTF associated with the sound source. An interaural time difference (ITD) is determined based on the first HRTF and second HRTF. A determination is made that the sound source is located in a first region based on the interaural time difference. A determination is made that the sound source is located in a second region within the first region based on the ITD of the first HRTF and the second HRTF and an ITD associated with third HRTFs for the second region. A location of the sound source is determined within the second region, which in some examples, is improved with a Kalman filter model.

20 Claims, 9 Drawing Sheets

(51) Int. Cl.
*H04R 5/033* (2006.01)
*H04R 3/00* (2006.01)
*H04R 1/40* (2006.01)

(52) U.S. Cl.
CPC ..... *H04R 5/033* (2013.01); *H04S 2400/15* (2013.01); *H04S 2420/01* (2013.01)

(58) Field of Classification Search
USPC .... 381/303, 310, 92, 56, 322, 122; 701/536; 700/94
See application file for complete search history.

(56) References Cited

U.S. PATENT DOCUMENTS

| | | | | |
|---|---|---|---|---|
| 9,980,077 | B2 | 5/2018 | Lee et al. | |
| 2015/0010160 | A1* | 1/2015 | Udesen | H04R 25/70 381/60 |
| 2016/0227338 | A1* | 8/2016 | Oh | H04S 7/303 |
| 2016/0381469 | A1* | 12/2016 | Kamkar-Parsi | H04R 25/505 381/23.1 |
| 2017/0359672 | A1* | 12/2017 | Lyren | H04R 5/033 |
| 2018/0139532 | A1* | 5/2018 | Jain | H04R 1/323 |

OTHER PUBLICATIONS

PCT Application Serial No. PCT/US2019/053391, International Written Opinion, dated Apr. 8, 2020, 5 pages.

* cited by examiner

BINAURAL SOUND SOURCE LOCALIZATION

RELATED DISCLOSURE

This disclosure claims the benefit of priority under 35 U.S.C. § 119(e) of U.S. Provisional Application No. 62/738,517 filed Sep. 28, 2018 entitled "Binaural Sound Source Localization" the contents of which are herein incorporated by reference in its entirety.

FIELD OF DISCLOSURE

The disclosure is related to consumer goods and, more particularly, to localizing a direction of a sound source when wearing a personal audio delivery device such as a headphone, headset, hearables, earbuds, hearing aids, or other ear accessories.

BACKGROUND

A human auditory system includes an outer ear, middle ear, and inner ear. With the outer ear, middle ear, and inner ear, the human auditory system is able to hear sound. For example, a sound source such as a loudspeaker in a room may output sound. A pinna of the outer ear receives the sound, directs the sound to an ear canal of the outer ear, which in turn directs the sound to the middle ear. The middle ear of the human auditory system transfers the sound into fluids of an inner ear for conversion into nerve impulses. A brain then interprets the nerve impulses to hear the sound. Further, the human auditory system is able to perceive the direction where the sound is coming from. The perception of direction of the sound source is based on interactions of the sound with human anatomy. The interaction includes the sound reflecting, reverberating and/or diffracting off a head, shoulder and pinna. The interaction generates audio cues which are decoded by the brain to perceive the direction where the sound is coming from.

It is now becoming more common to listen to sounds wearing personalized audio delivery devices such as headphones, headsets, hearables, earbuds, hearing aids, or other ear accessories. The personalized audio delivery devices outputs sound, e.g., music, into the ear canal of the outer ear. For example, a listener wears an earcup seated on the ear which outputs the sound into the ear canal. Alternatively, a bone conduction headset vibrates middle ear bones to conduct the sound to the human auditory system. The listener listens to the sound output by the personal audio delivery device at the expense of usually not being able to hear and/or perceive a direction of sounds around the listener. Examples of such sounds includes people talking around the listener or a horn of a vehicle. The listener might hear the sound, but not be able to determine a direction of a sound source which outputs the sound. The sound does not interact with the human anatomy such as the pinna such that audio cues indicative of direction are generated.

BRIEF DESCRIPTION OF THE DRAWINGS

Features, aspects, and advantages of the presently disclosed technology may be better understood with regard to the following description, appended claims, and accompanying drawings where:

Figure 1:
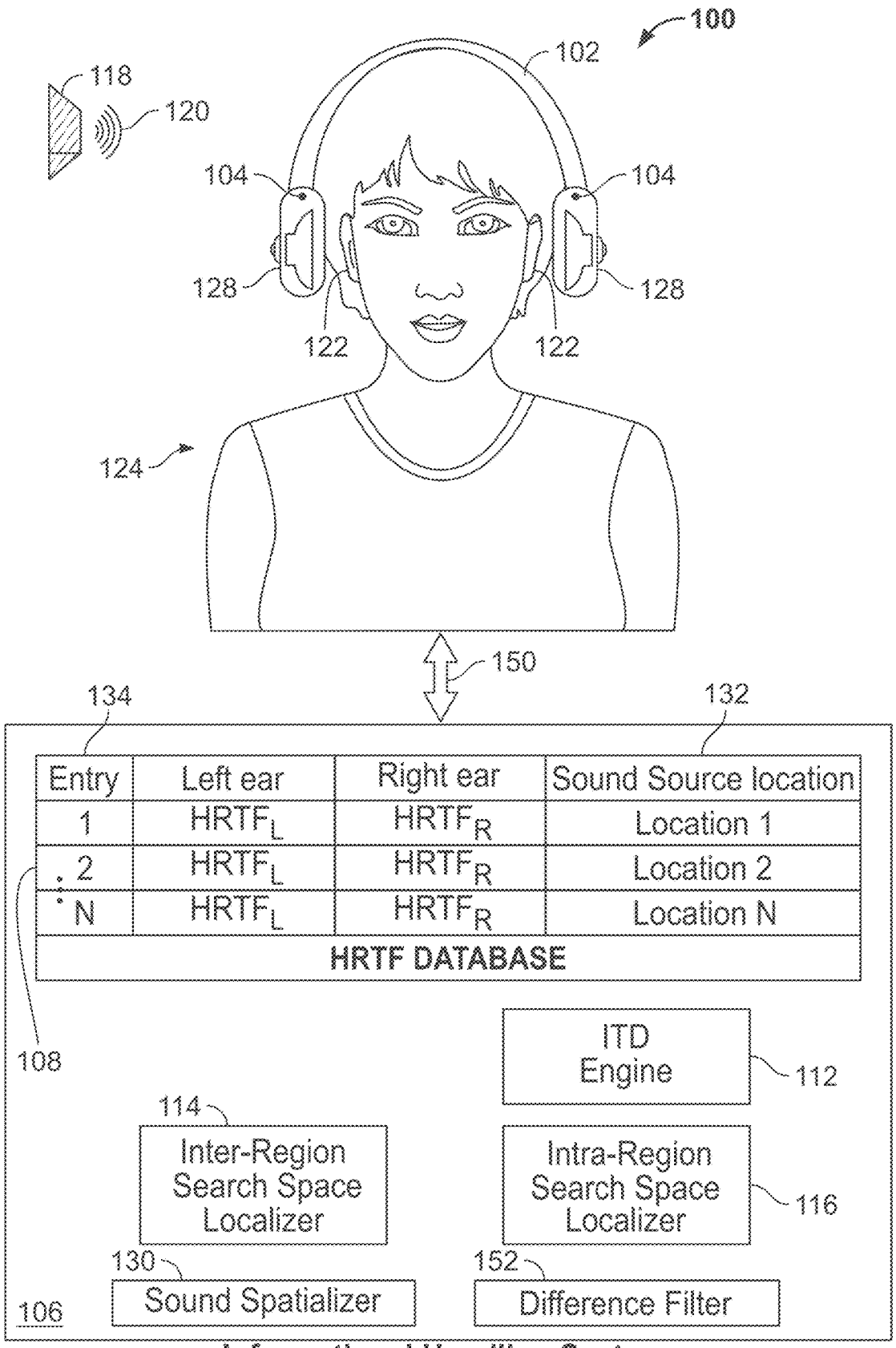
FIG. 1 is an example block diagram of a sound localization system for determining a location of a sound source.

The drawings are for the purpose of illustrating example embodiments, but it is understood that the embodiments are not limited to the arrangements and instrumentality shown in the drawings.

DETAILED DESCRIPTION

The description that follows includes example systems, methods, techniques, and program flows that embody the disclosure. However, it is understood that this disclosure may be practiced without these specific details. For instance, this disclosure describes a process of sound localization using two microphones, one associated with each ear, in illustrative examples. Aspects of this disclosure can be also applied to applications other than sound localization. Further, well-known instruction instances, protocols, structures and techniques have not been shown in detail in order not to obfuscate the description.

Overview

A listener wears a personal audio delivery device such that a left earpiece is positioned on a left ear and a right earpiece is positioned on a right ear. To spatialize sound from the sound source, the personal audio delivery device can be arranged with an array of two, three, or more microphones associated with each ear which are pointed in different directions to determine a location of the sound source. The personal audio delivery device then performs beamforming on the detected sound to determine the location of the sound source. A head related transfer function (HRTF) associated with the location of the sound source facilitates generating audio cues to spatialize the sound from the sound source. The HRTF characterizes how the sound output by the sound source would be received by a human auditory system based on interaction with the ear, head, and/or torso. The personal audio delivery device uses the HRTF to artificially generate the audio cues that allow the listener to perceive an azimuth, elevation, distance of the sound output by the sound source. The personal audio delivery device then outputs the audio cues to spatialize the sound for the listener based on the location of the sound source.

Embodiments described herein are directed to determining a location of a sound source using two microphone of a personal audio delivery device, one associated with each ear, rather than the two, three, or more microphones associated with each ear used for performing beamforming. The two microphones are a left microphone mounted on the left earpiece of the personal audio delivery device and a right microphone mounted on a right earpiece of the personal audio delivery device. The determination of the location of the sound source using one microphones rather than three microphones for each ear reduces a complexity associated with spatializing sound from the sound source.

The two microphones, such as a left and right microphone of the personal audio delivery device output respective microphone signals. The microphone signals are analog or digital electrical signals indicative of the sound detected by each microphone from a sound source when the personal audio delivery device is worn by the listener. Because the left earpiece with the left microphone is worn on the left ear, the right earpiece with the right microphone is worn on the right ear, each microphone signal is an HRTF, referred to as a personal audio delivery device (PADD) HRTF. The left microphone is associated with a left PADD HRTF and the right microphone is associated with a right PADD HRTF. One or more filters may be applied to each of the PADD HRTFs. The filters may include one or more of a low pass filter, band pass filter, and/or high pass filter to reduce and/or amplify certain frequencies of the PADD HRTFs. Based on the PADD HRTFs, an inter-aural time difference (ITD) may be determined. The ITD is an indication of how long sound generated by the sound source takes to reach one ear and then another ear. Based on the ITD of the PADD HRTFs, a region is determined where the sound source is located. The ITD of the PADD HRTFs is compared to ITDs of a left reference HRTFs and right reference HRTFs for different locations of a test sound source within the region. The reference HRTFs are personal HRTFs to the listener or HRTFs associated with a general population. A reference HRTF may be measured in a controlled laboratory environment by positioning a microphone at an entrance of an ear canal, positioning the test sound source at a known location, and receiving a signal from the microphone indicative of the reference HRTF. The HRTF determined based on the microphone located in an ear canal of the left ear is a left reference HRTF and the HRTF determined based on the microphone located in an ear canal of the right ear is a right reference HRTF for the known location of the test sound source. The process is repeated for different known locations of the test sound source to obtain a plurality of reference HRTFs. The known locations of the test sound source associated with the reference HRTFs which match the PADD HRTFs within a predefined tolerance are indicative of possible locations of the sound source. In some examples, a difference filter is applied to the reference HRTFs to account for a difference in position between the microphone used to determine the PADD HRTFs and the microphone to determine the reference HRTFs. The difference filters result in a more accurate matching. The possible locations of the sound source are then further localized by a cross convolution process. The reference HRTFs are a more accurate indicator of the HRTF of the listener compared to the PADD HRTF. The reference HRTFs associated with the location of the sound source are then used to spatialize the sound from the sound source for the listener while wearing the personal audio delivery device. In this regard, using the two microphones, one associated with each ear, rather than three or more microphones associated with each ear reduces cost and computational complexity associated spatializing the sound from the sound source.

The description that follows includes example systems, apparatuses, and methods that embody aspects of the disclosure. However, it is understood that this disclosure may be practiced without these specific details. In other instances, well-known instruction instances, structures and techniques have not been shown in detail in order not to obfuscate the description.

DETAILED EXAMPLES

FIG. 1 is an example block diagram of a sound localization system 100 arranged to determine a location of a sound source 118. The sound localization system 100 includes a personal audio delivery device 102, two microphones 104, and an information handling system 106 such as a computer system.

The personal audio delivery device 102 may be a headphone, headset, hearables, earbuds, hearing aids, or other ear accessories worn by a listener 124 which outputs sound such as music directly into the human auditory system. The listener 124 may wear earpieces 128 of the personal audio delivery device 102 which output sound such as music into each ear 122. For example, an earpiece 128 in the form of an earcup of a headphone may be placed on an ear 122 of the listener 124 and a transducer in the earcup may output sound into the ear 122 of the listener 124. As another example, an earpiece 128 in the form of a hearing aid may be placed on the ear 122 of the listener 124 and a transducer in the hearing aid may output sound into the ear 122 of the listener 124. The personal audio delivery device 102 may have one microphone 104 located on a casing of the earpiece 128. In examples, one microphone 104 may be located at a front or rear of the respective casing of the earpiece 128. One earpiece may be positioned on a left ear and one earpiece may be positioned on the right ear. The sound source 118 may output sound 120. For example, the sound source 118 may be a speaker, a car horn, or a person talking which may be positioned at an unknown location with respect to the listener 124. The microphone 104 may convert the sound 120 output by the sound source 118 into a microphone signal which is provided to the information handling system 106.

The information handling system 106 may be local or remote to the personal audio delivery device 102 and/or coupled via a communication path 150 which may take the form of a wireless or wired connection. The information handling system 106 may have a head related transfer function (HRTF) database 108, an interaural time difference (ITD) engine 112, an inter-region search space localizer 114, and intra-region search space localizer 116. Each of the two microphones 104 outputs a respective microphone signal based on the sound 120 received by each of the two microphones 104 of the personal audio delivery device 102 for the sound source 118. The microphone signals may be analog or digital electrical signals indicative of the sound detected by each microphone 104 from the sound source 118. Because the left earpiece with the left microphone is worn on the left ear, the right earpiece with the right microphone is worn on the right ear, each microphone signal is an HRTF, referred to as a personal audio delivery device (PADD) HRTF. The left microphone is associated with a left PADD HRTF and the right microphone is associated with a right PADD HRTF. The PADD HRTFs characterize how sound from the sound source 118 is received by a human auditory system. The PADD HRTF may be represented in the frequency domain or time domain. In some examples, the representation in the time domain is known as a head related impulse response (HRIR).

The HRTF database 108 may include reference HRTFs. The reference HRTFs are personal HRTFs to the listener or general HRTFs associated with a general population. The personal HRTFs are associated with anthropometric features of the pinna of the listener compared to the general HRTFs which are associated with anthropometric features of the pinna of the general population. A reference HRTF may be measured in a controlled laboratory environment by positioning a microphone at an entrance of an ear canal, positioning a test sound source at a known location, and receiving a signal from the microphone indicative of the reference HRTF. The test sound source whose location is known is not the same as sound source 118 whose location is not known. The HRTF database 108 may have a table 132 with a plurality of entries 134. Each entry 134 includes a reference HRTF for the left ear ($HRTF_L$) and a reference HRTF for the right ear ($HRTF_R$) along with a respective known location of the test sound source used to determine the reference HRTFs. The left reference HRTF is measured using a microphone at an entrance of an ear canal of the left ear and right reference HRTF is measured using a microphone at an entrance of an ear canal of the right ear. In this regard, the table 132 may have a plurality of entries 1 . . . N where each entry 134 is associated with the reference HRTF for a left ear and a reference HRTF for a right ear and the known location of the test sound source used to determine the reference HRTFs.

The ITD engine 112 may determine a difference in time when the sound 120 from the sound source 118 sound reaches one ear and then the other ear. ITD is an essential spatial audio cue that human beings use in order to localize sound. An ITD may be calculated based on the PADD HRTF associated with each microphone 104. In some examples, the ITD may be based on a cross correlation of the PADD HRTFs.

The information handling system 106 may determine a location of the sound source 118 which is unknown, without the complexity of having to use microphone arrays with two, three or more microphones and the beamforming of prior art methods. The location may be identified in terms of regions. For example, areas to the left or right of the listener, behind or in front of the listener, and/or above or below the listener may be defined as regions. The inter-region search space localizer 114 may determine the location of the sound source 118 in terms of a region based on the ITD of the PADD HRTFs. The intra-region search space localizer 116 may determine the location of the sound source 118 within a determined region. The ITD of the PADD HRTFs may be compared with an ITD of the left and right reference HRTFs associated with a given location in the determined region. This process may be repeated for each entry of reference HRTFs in the HRTF database 108 associated with a location in the determined region. If a reference HRTF has an ITD which does not match an ITD of a PADD HRTF, then the given location associated with the reference HRTFs may not be the location of the sound source 118. If a reference HRTF has an ITD which matches an ITD of an PADD HRTF, then the given location associated with the reference HRTFs may be the location of the sound source 118. In some examples, a difference filter 152 is applied to the reference HRTFs to account for a difference in position between the microphone 104 used to measure the PADD HRTFs and the microphone used to measure the reference HRTFs. The difference filters result in a more accurate matching. The intra-region search space localizer 116 may further localize the location of the sound source 118 based on a cross-convolution process with the reference HRTFs.

By determining the location of the sound source 118, a sound spatializer 130 may spatialize the sound 120 such that it appears to come from that location in one or more of azimuth, elevation, distance, and/or velocity. The reference HRTFs may be a more accurate indicator of the HRTF of the listener 124 compared to the PADD HRTF. The sound spatializer 130 may convolve the sound 120 received by the microphones 104 with the reference HRTFs associated with the location of the sound source 118 to output audio cues. The audio cues spatialize the sound 120 from the sound source 118 for the listener 124 while the listener is wearing the personal audio delivery device 102.

Figure 2:
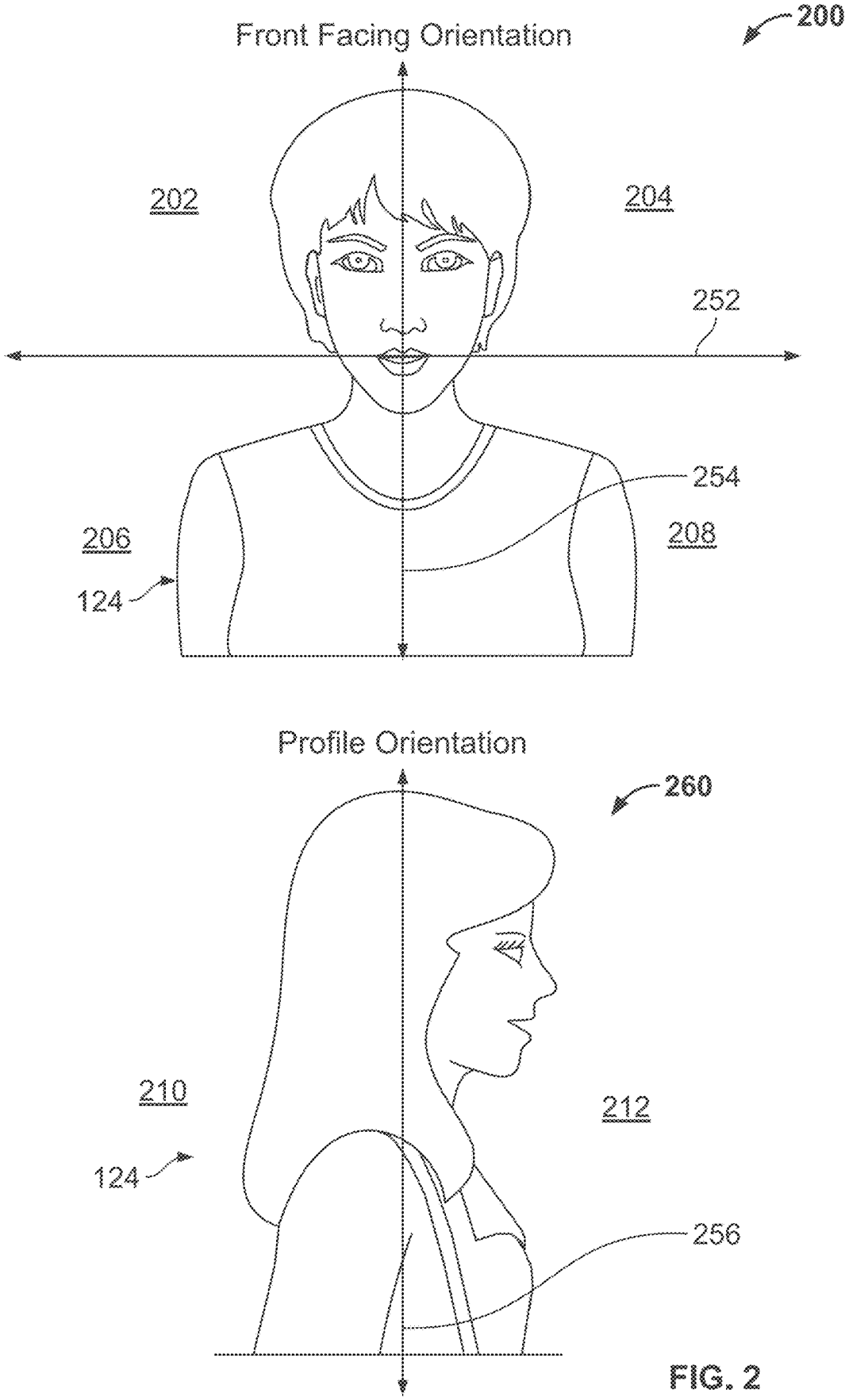
FIG. 2 illustrates example regions where the sound source could be located with respect to a listener.

FIG. 2 illustrates example regions 202-212 where the sound source could be located with respect to the listener. The example regions 202-208 may be areas around the listener 124 defined by lines of symmetry, examples of which are shown as lines 252, 254 for a front orientation 200 of the listener 124 and line 256 for a profile orientation 260 of the listener 124. For the front orientation 200 of the listener 124, the regions may include areas to the left or right of the listener 124 which are shown as regions 202, 206 (also referred to a left hemisphere) and 204, 208, respectively, (referred to a right hemisphere) for line 254 and areas above or below the listener 124 which are shown as regions 202, 206 or 204, 208, respectively, for line 252. The sound source may also be located behind or in front of the listener which are shown as region 210 or region 212 respectively, for line 256 of symmetry in the profile orientation 260 of the listener 124. Locations where the sound source may be located around the listener 124 may be identified in other ways as well.

Figure 3:
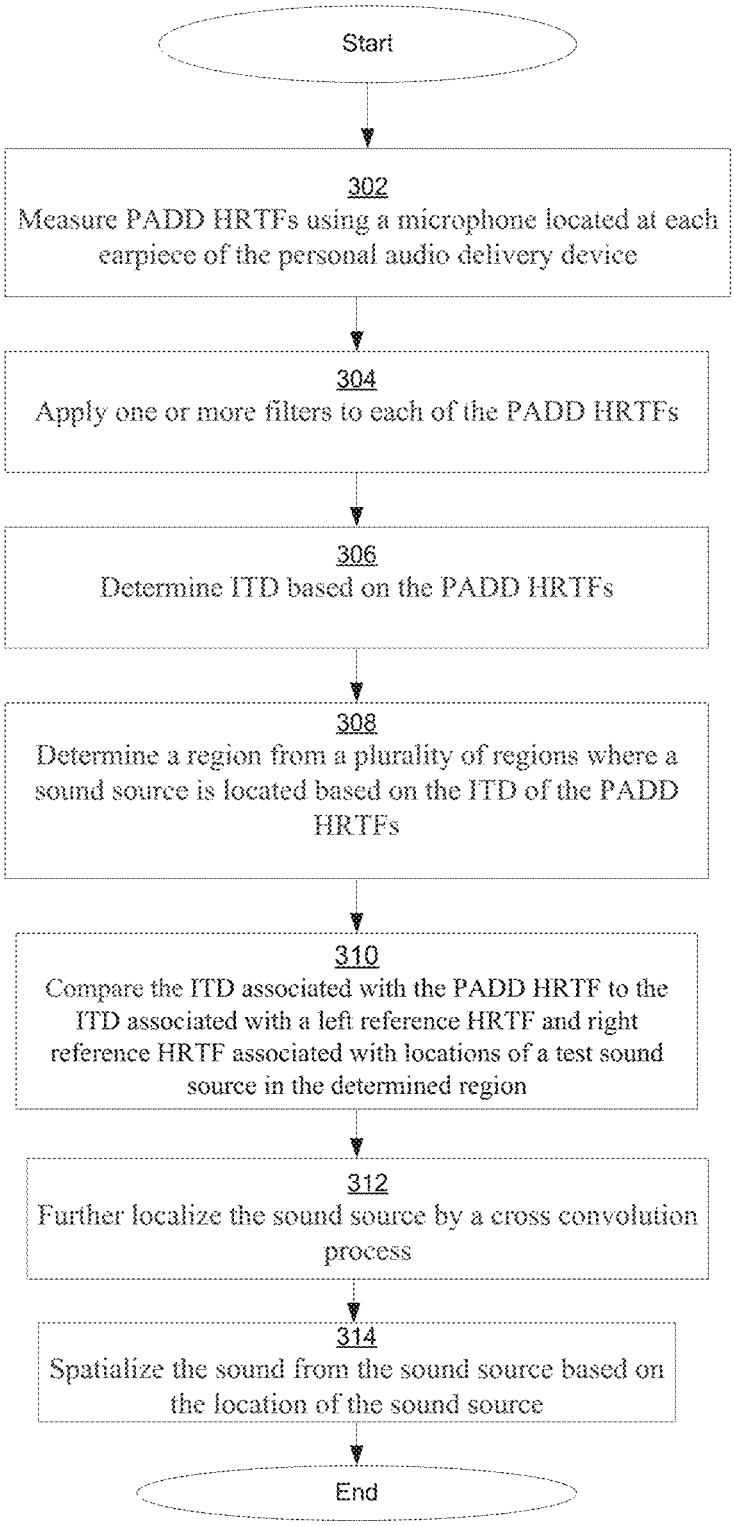
FIG. 3 is an example flow chart of functions associated with determining the location of the sound source.

FIG. 3 is an example flow chart 300 of functions associated with determining a location of a sound source. For example, a sound source may output sound but the location of the sound source with respect to the listener may be unknown. By determining the location, the sound output by the sound source can be spatialized to the listener. The functions may be performed by the information handling system in hardware, software, and/or a combination of hardware and software.

At 302, HRTFs may be measured using a microphone located at each earpiece of the personal audio delivery devices. A microphone may convert sound from the sound source sound into a microphone signal. Because the left earpiece with the left microphone is worn on the left ear, the right earpiece with the right microphone is worn on the right ear, each microphone signal is an HRTF, referred to as a personal audio delivery device (PADD) HRTF. The left microphone is associated with a left PADD HRTF and the right microphone is associated with a right PADD HRTF.

At 304, one or more filters may be applied to each of the PADD HRTFs. The filters may include one or more of a low pass filter, band pass filter, and/or high pass filter to reduce and/or amplify certain frequencies of the PADD HRTFs. For example, the filter may have a cut-off frequency of 1500 Hz which is applied to the left and right PADD HRTFs. The filtering facilitates determination of an ITD which is primarily a low-frequency audio cue by eliminating high-frequency noise in the PADD HRTFs.

At 306, an ITD may be determined based on the PADD HRTFs. For example, the ITD engine may determine a time difference between when sound reaches one ear and then another ear based on the PADD HRTFs. The ITD is an indication of how long sound generated by a sound source, x(t) takes to each one ear and then another ear. For example, sound may take $T_L$ amount of time to reach the left ear and $T_R$ amount of time to reach the right ear. A time difference may be determined between $T_L$ and $T_R$. For example, the PADD HRTF for the left and right microphone can be time shifted relative to each other until they are substantially aligned and a size of this shift is recorded as the ITD. In this regard, the ITD may be calculated by computing a cross-correlation taking the maximum correlation lying between +−1 ms as the ITD.

At 308, a region from a plurality of regions is determined where a sound source is located based on the ITD of the PADD HRTFs. In examples, the inter-region search space localizer may determine the region where the sound source is located. The ITD represents a difference in time arrival of sound from the sound source at the two ears in the time domain. Based on a sign of the ITD, a determination can be made whether the sound is coming from the left or right hemisphere with respect to the listener. For example, if the sign of the ITD is greater than zero, the sound may be coming from the left hemisphere. As another example, if the sign of the ITD is less than zero, the sound may be coming from the right hemisphere. Accordingly, the determination of whether the sound source is located in the left or right hemisphere is based on a sign of the ITD.

In addition, directional bands such as Blauert's directional bands can be used to further distinguish whether the sound source is in the front, the back, above, or below the listener. The PADD HTRF may have frequency characteristics such as frequency bands with predefined amplitudes indicative of the sound source being in the front, back, above, or below the listener. The PADD HTRF may be analyzed to determine whether it has the frequency characteristics associated with the sound source being front of the listener. If the PADD HTRF has the frequency characteristics, then the sound source is located in the front of the listener. As another example, the PADD HTRF may be analyzed to determine whether it has the frequency characteristics associated with the sound source being behind the listener. If the PADD HTRF has the frequency characteristics, then the sound source is located behind the listener. In yet another example, the PADD HTRF may be analyzed to determine whether it has the frequency characteristics associated with the sound source being above the listener. If the PADD HTRF has the frequency characteristics, then the sound source is located above the listener. As another example, the PADD HTRF may be analyzed to determine whether it has the frequency characteristics associated with the sound source being below the listener. If the PADD HTRF has the frequency characteristics, then the sound source is located below the listener.

At 310, the ITD of the PADD HRTF is compared to the ITD of a left reference HRTF and right reference HRTF associated with locations of a test sound source within the determined region at 308. The reference HRTFs may be stored in the HRTF database. In examples, the intra-region search space localizer may perform this function. The ITD of the left and right reference HRTF associated with the different locations of the test sound source may be computed by the ITD engine and/or precomputed in a manner similar to how the ITD is computed for the PADD HRTF. The ITD of the PADD HRTFs and ITD of the left reference HRTF and right reference HRTF associated with each location of the test sound source is compared to a predefined tolerance. The predefined tolerance defines an amount of search space reduction that can be obtained. If the difference in ITDs is less than the amount of the tolerance, then the sound source may be located at the location of the test sound source associated with the reference HRTFs. This process is repeated for each of the different locations of the test sound source. The comparison of ITDs may result in localizing the sound source to N>=1 possible locations characterized as a sub-region within the determined region at 308. In this regard, step 308 reduces a number of comparisons of ITDs which need to be performed in step 310. If step 308 is not performed, the ITD of the PADD HRTF would have to be compared to the ITD of the left reference HRTF and right reference HRTF associated with locations of the test sound source within a plurality of regions, adding to the complexity of determining the N possible locations of the sound source determined in step 310.

At 312, the location of the sound source is further localized by a cross convolution process. The cross convolutional process narrows down a location of the sound source to one of the N possible locations, where the location of the sound source is initially unknown. To begin, left and right observation of sound, $X_L$ and $X_R$, respectively, at the ear may be determined based on sound S convolved with a reference HRTF associated with a possible location of the sound source identified in step 310. The left and right observation of sound, $X_L$ and $X_R$ may be filtered or convolved with contralateral PADD HRTFs associated with the location of the sound source whose location represented by i is initially unknown. The filtered signals are then converted to a frequency domain, if not already in the frequency domain, and this process is repeated for each of the N possible locations of the sound source to determine the reference HRTF associated with a maximum cross-correlation between left and right observations of sound. The maximum cross correlation indicates that the same sound source generates the same left and right observations of sound at the personal audio delivery device, i.e., when $i=i_0$, and $i_o$ is the location with maximum correlation. Mathematically, this process is described as follows:

$$\begin{aligned}\widehat{S_{L,i}} &= H_{R,i}\cdot X_L\\ &= H_{R,i}\cdot H_{L,i_0}\cdot S\\ &= H_{L,i}\cdot H_{R,i_0}\cdot S\\ &= H_{L,i}\cdot X_R\\ &= \widehat{S_{R,i}} \Leftrightarrow i = i_0\end{aligned}$$

$$\text{argmax}_{io}\{F(\widehat{S_{L,i}})\otimes F(\widehat{S_{R,i}})\}$$

where, $\widehat{S_{L,i}}$ and $\widehat{S_{R,i}}$ are the cross convolutions of the left and right observations of sound at the personal audio delivery device. $H_{L,io}$ and $H_{R,io}$ are the reference HRTFs for a location $i_0$. $H_{L,i}$ and $H_{R,i}$ are contralateral PADD HRTFs when the sound source is located at the location i which is initially unknown. The location of the sound source $i_0$ associated with the reference HRTF with maximum cross correlation indicates the location of the sound source i.

In some examples, the sound source location may be determined by the following calculation:

$$\widehat{S_{L,i}} = X_L/H_{L,io}$$

$$\widehat{S_{R,i}} = X_R/H_{R,io}$$

$$\text{Where arg min}_{io}\{\text{abs}((\widehat{S_{L,i}})-(\widehat{S_{R,i}}))\}$$

When $\widehat{S_{L,i}}$ and $\widehat{S_{R,i}}$ are the same, then the location associated with the reference HRTFs indicates the location $i_0$ of the sound source. However, unlike the cross correlation method, an inverse of $H_{L,io}$ and $H_{R,io}$ is calculated which might result in instabilities if the magnitude of $H_{L,io}$ and $H_{R,io}$ is near zero.

At 314, the personal audio delivery device may spatialize the sound from the sound source based on the location of the sound source determined by the cross-convolution process. The reference HRTFs are a more accurate indicator of the HRTF of the listener compared to the PADD HRTF. The information handling system may apply, e.g., convolve, the left reference HRTFs associated with the location $i_0$ to the sound received by the left microphone and the right reference HRTFs associated with the location $i_0$ to the sound received by the right microphone to spatialize the sound. The spatialized sound may appear that it comes from the direction of the sound source while the listener is wearing the personal audio delivery device, e.g., at one or more of an azimuth, elevation, distance, and/or velocity.

Figure 4:
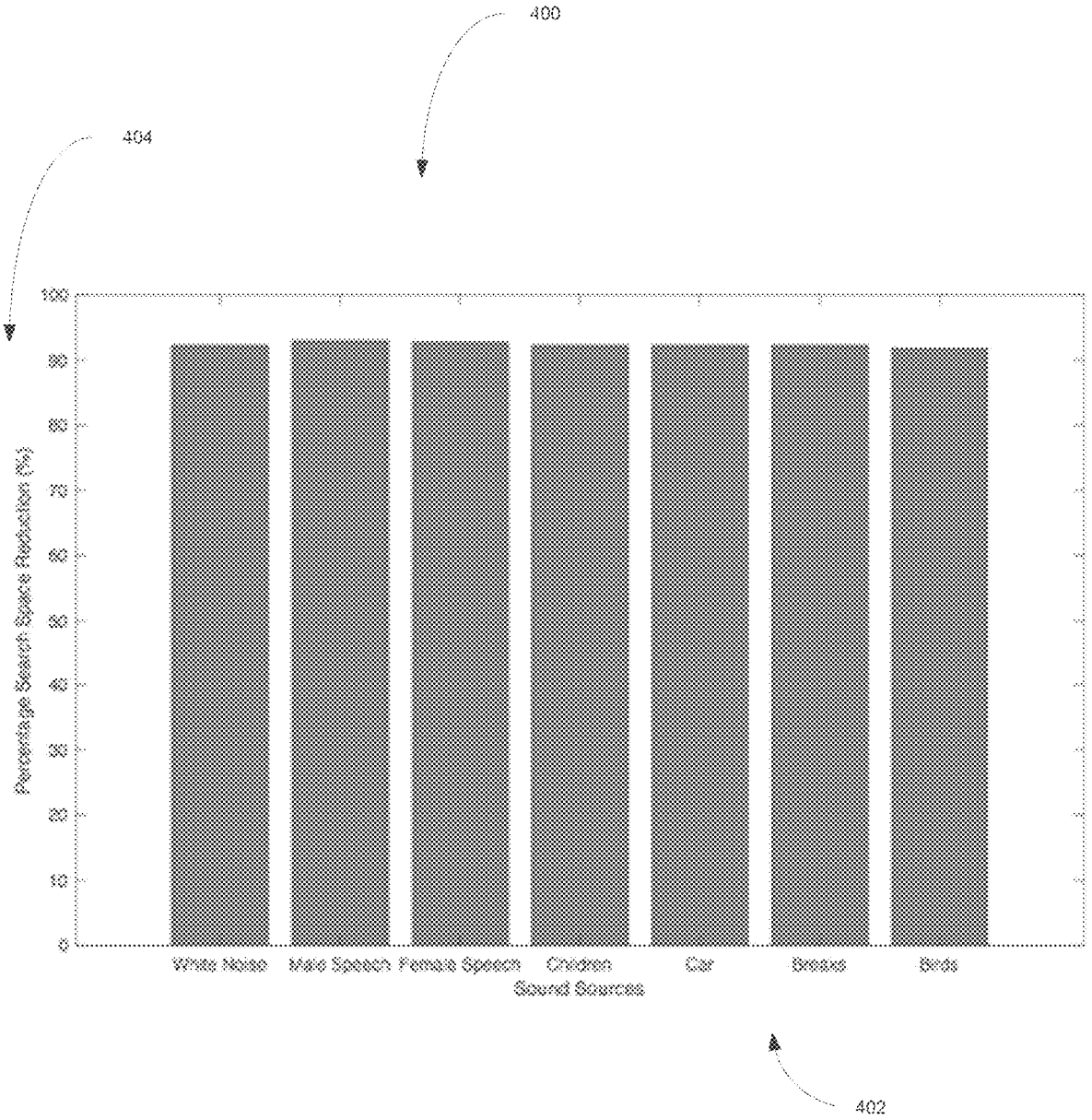
FIG. 4 is an example bar graph which shows how a search space for localizing the sound source varies based on a sound source type.

FIG. 4 is an example bar graph 400 which shows how search space among regions and within a region are reduced by the ITD comparisons for different types of sound sources. The bar graph 400 plots the types of sound sources versus percentage reduction in search space. The types of sound sources are identified on axis 402 and the percentage reduction in search space is shown on axis 404. The PADD HRTF and reference HRTFs may be represented as digital samples with a given sampling rate such as 1/44 KHz. Based on identification of in-ear and PADD HRTFs with an ITD of +/−2 sample time resolution for given locations of a sound source, the average search space reduction for different sources is close to 92%. This means that if there are 1250 possible sound source locations, only 100 directions may need to be searched in order to find the exact sound source location.

Each reference HRTF in the HRTF database may be measured by a microphone positioned at an entrance of the ear canal and associated with a given location of a sound source. The PADD HRTFs are measured by a microphone positioned on the earpiece of the personal audio delivery device and not at the entrance of the ear canal. For example, one microphone may be placed in front or behind a hearing aid casing or on an earcup casing. The different position of the microphone associated with the reference HRTF and PADD HRTF results in the reference HRTFs and the PADD HRTFs inherently differing for a same location of the sound source.

Figure 5:
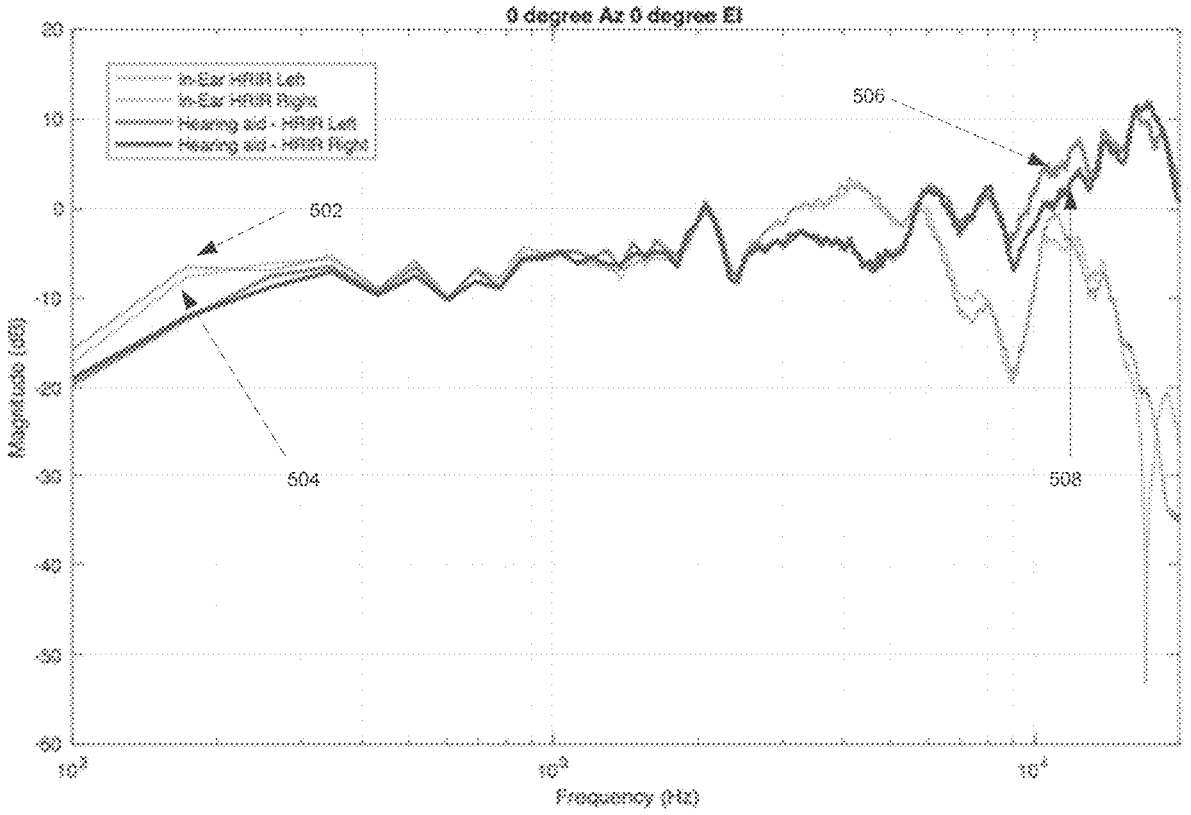
FIG. 5 illustrates an example difference between head related transfer functions (HRTFs) measured by a microphone located at an entrance of an ear canal and HRTFs measured by a microphone of the personal audio delivery device.

FIG. 5 illustrates an example of how the difference between an in-ear HRTF and the PADD HRTF measured by the personal audio delivery device for a zero azimuth and zero elevation position of the sound source. The in-ear HRTF (referenced as "in-ear HRIR) is an HRTF measured based on a microphone placed at the entrance of a pinna. Curves show an in-ear HRTF 502 associated with the left ear, an in-ear HRTF 504 associated with the right ear, a PADD HRTF 506 (referenced as "Hearing Aid—HRIR") associated with the left ear of the personal audio delivery device, and an PADD HRTF 508 associated with the right ear of the personal audio delivery device. As shown the HRTFs 502, 506 associated with the in-ear response differs from the HRTFs 506, 510 associated with the sound source located at zero-degree azimuth and zero-degree elevation.

In examples, the reference HRTF may be adjusted for a difference in position of the microphone used to determine the reference HRTF compared to the position of the microphone used to measure the PADD HRTF to facilitate comparison of respective ITDs. Alternatively, the PADD HRTF may be adjusted for a difference in position of the microphone used to measure the PADD HRTF compared to the position of the microphone used to determine the reference HRTF. For example, the reference HRTF may be adjusted as if it was determined based on a microphone on the earpiece of the personal audio delivery device. As another example, the PADD HRTF may be adjusted as if it was measured by the microphone at an entrance of the ear canal. This adjustment is carried out using a difference filter. The difference filter adjusts one of the reference HRTF and PADD HRTF for a difference in microphone position. Additionally, the difference filter compensates for the variations in position of the microphone on the earpiece of the personal audio delivery device with respect to the listener's head each time the listener places the personal audio delivery device on his head.

Figure 6:
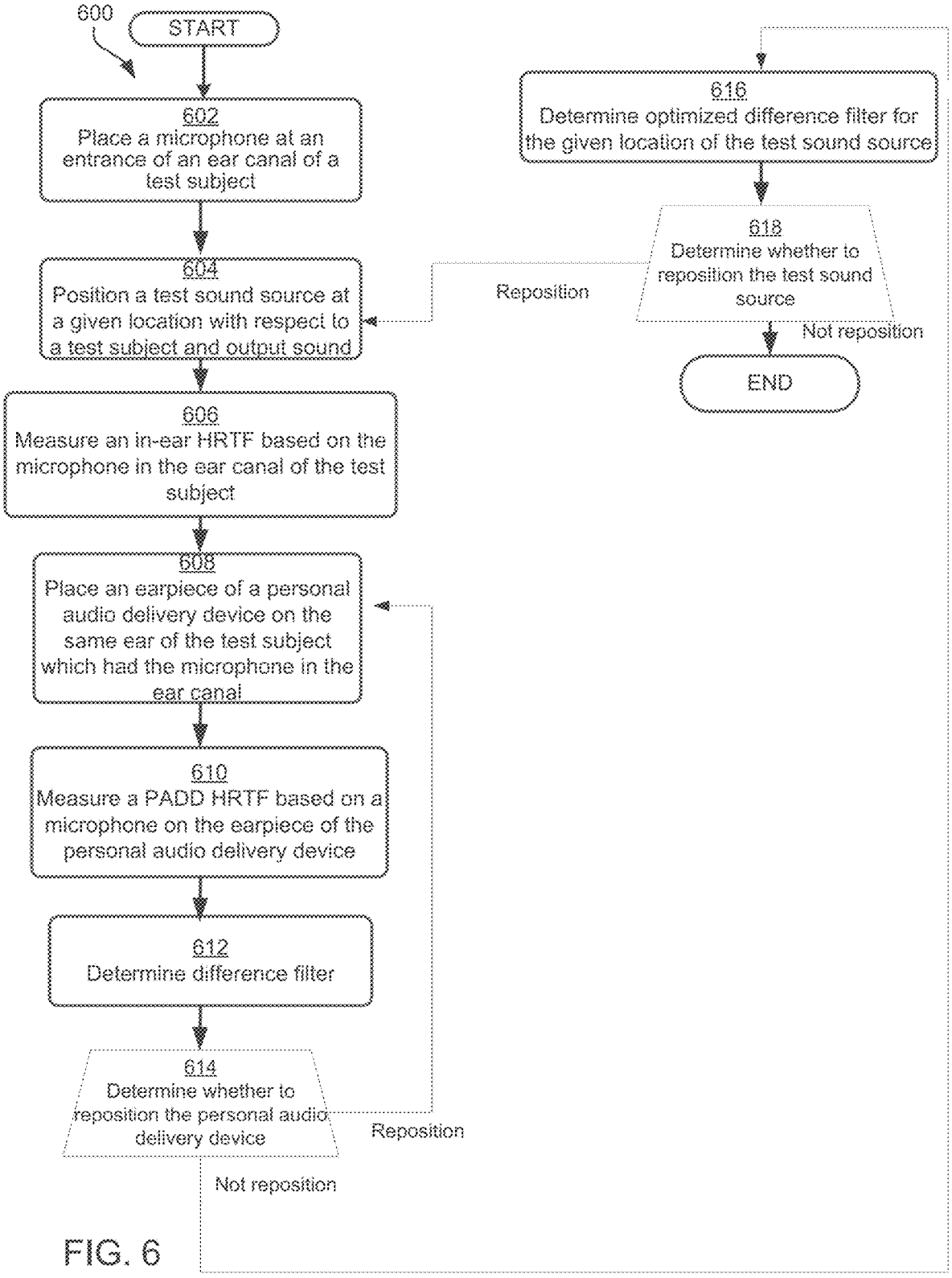
FIG. 6 is an example flow chart of functions associated with determining a difference filter.

FIG. 6 is an example flow chart of functions associated with determining the difference filter. The determination of the difference filter may be performed in a controlled laboratory environment and then used by the information processing system to adjust one or more of the in-ear HRTFs and PADD HRTFs.

At 602, a microphone is placed at an entrance of an ear canal of a test subject. The ear canal may be associated with an anatomical model of a human being which includes a head and torso (both of which is referred to as the test subject) in a controlled laboratory environment. The ear canal may be associated with a left ear or right ear.

At 604, a test sound source may be positioned at a given location with respect to the test subject and output sound. This test sound source is not the sound source discussed above whose location is unknown. Instead, the location of the test sound source is known.

At 606, an HRTF is measured based on the microphone placed at the entrance of the ear canal which is referred to as an in-ear HRTF. The in-ear HRTF may be based on the sound source at the given location. The in-ear HRTF may be in a time domain or frequency domain, in which case the HRTF may also be referred to as an HRIR.

At 608, an earpiece of the personal audio delivery device is placed on the same ear of the test subject which had the microphone at the entrance of the ear canal.

At 610, an HRTF is measured based on a microphone on the earpiece of the personal audio delivery device which is referred to as a PADD HRTF. The microphone that is used may be a left microphone on the left earpiece of the personal audio delivery device if the in-ear HRTF measurement was performed for a left ear. Alternatively, the microphone that is used may be a right microphone on the right earpiece of the personal audio delivery device if the in-ear HRTF measurement was performed for a right ear.

At 612, a difference filter is determined based on the in-ear HRTF and the PADD HRTF. For example, the difference filter is determined by inverting the in-ear HRTF to produce an inverted response and convolving with the PADD HRTF:

$$\text{Diff} - \text{Filter} = \frac{HRTF_{PADD}}{HRTF_{in\text{-}ear}} \tag{1}$$

In examples, the difference filter may be used to modify the in-ear HRTFs to estimate the HRTF measured by the microphone on the earpiece of the personal audio delivery device. The difference filter may take a similar form to modify the PADD HRTFs to estimate the HRTF measured by a microphone at the entrance of the ear canal. The difference filter calculation may be performed in a frequency domain or time domain. In a frequency domain, the in-ear HRTF may include notch responses where an amplitude decreases close to zero and then increases, resulting in the inverted response producing peaks with excessive amplitude. In some examples, the amplitude of the inverted response may be thresholded to a maximum value such as 110 dB. Similar processing may also be invoked when the difference filter calculation is performed in the time domain.

At 614, a determination is made whether to reposition the personal audio delivery device. The personal audio delivery device is repositioned for one or more positions of the personal audio delivery device on the test subject in order to account for variability in the HRTF measurements for the different positions (e.g., angles) that the personal audio delivery device is worn on the head by the test subject and resulting positions of the microphone on the earpiece of the personal audio delivery device. If the personal audio delivery device is repositioned at 608, then additional HRTF measurements may be performed by the microphone on the earpiece of the personal audio delivery device for the location of the sound source and additional difference filters determined for the repositioned personal audio delivery device.

At 616, an optimized difference filter for the given test sound source location is determined which is agnostic to how the personal audio delivery device is positioned on the test subject. The optimized difference filter may be an average of the difference filters.

At 618, a determination is made whether the test sound source is to be repositioned. The test sound source is moved to one or more locations around the test subject with a given resolution, and additional in-ear HRTFs are measured. For example, the in-ear HRTF may be measured a resolution of 10 degrees azimuth by 10 degrees elevation around the test subject. If in-ear HRTFs have not been received for all the locations, at 604 the test sound source is moved to another location and additional in-ear HRTFs are received to determine additional difference filters for the various locations of the test sound source. In this regard, a difference filter may be determined for each location of the test sound source around the listener. The difference filter may be associated with the left ear or right ear depending on whether the microphone for determining the in-ear HRTF is on the left ear or right ear. In this regard, the steps 602-618 may be repeated for the other ear.

The difference filter may be determined in other ways. For example, the PADD HTRFs for the different positions that the personal audio delivery device is worn on the head may be averaged for a given test sound source location and the optimized difference filter computed based on the averaged PADD HRTFs and the in-ear HRTF for a given test sound source location. This process is repeated for each test sound source location to determine the optimized difference filter for each test sound source location. In this regard, the difference filter for each position of the personal audio delivery device is not averaged to determine the optimized difference filter. Other variations are also possible.

The difference filter is used to adjust the reference HRTF. The reference HRTF is measured based on a microphone located in an ear canal and associated with a location of a test sound source. The reference HRTF is multiplied and/or convolved with the difference filter associated with the same location of the test sound source in order to produce an adjusted reference HRTF. The adjusted reference HRTF is an estimate of the HRTF measured by the microphone on the earpiece of the personal audio delivery device. The adjustment may be made for the reference HRTFs associated with each ear and for each location of the sound source. In examples, this adjusted reference HRTF may be used at steps 310 and 312 of FIG. 3 to facilitate comparison with the PADD HRTFs. If the difference between the adjusted reference HRTF and PADD HRTF is less than a predefined threshold, then the location associated with the reference HRTF which is adjusted may be a possible sound source location. Alternatively, the PADD HRTF for each microphone may be adjusted with a difference filter rather than the reference HRTF. In this case, the difference filter may be an inverse of equation 1 described above.

In some examples, a Kalman filter model can be used to improve localization accuracy in presence of external noise for a moving sound source. An input to the Kalman filter model is a measurement which is known to have some error, uncertainty, or noise over time. The Kalman filter model uses a series of the measurements observed over time, containing the external noise and other inaccuracies, and produces estimates of a state of a system over time. The Kalman filter model assumes that the state of the system at a time t evolved from a prior state at time t−1 according to the equation:

$$x_t = F_t x_{t-1} + B_t \mu_t + n_t$$

Where $x_t$=state vector containing terms of interest for the system (e.g., position, velocity, heading etc. at time t), $u_t$=vector containing any control inputs (steering angle, throttle setting, etc.), $F_t$=state transition matrix which applies an effect of each system parameter at time t−1 on the system state at time t (e.g., position and velocity at time t−1 both affect the position at time t)

$B_t$=control input matrix which applies an effect of each control input vector in the vector $u_t$, and $n_k$ is a process noise which is assumed to be drawn from a zero mean multivariate normal distribution, with covariance, $Q_k$.

In examples, the state of the Kalman filter model is represented by two variables:

$X_{t|t-1}$, the a posteriori state estimate at time k given observations up to and including at time k;

$P_{t|t-1}$, an a posteriori error covariance matrix (a measure of estimated accuracy of the state estimate);

which are represented by the following equations:

$$\hat{x}_{t|t-1} = F_t \hat{x}_{t-1|t-1} + B_t \mu_t$$

$$P_{t|t-1} = F_t P_{t-1|t-1} F_t^T + Q_t,$$

The state vector is defined as $[x_1, x_2, v, h, w]^T$, $u_t$=0 (since there's no control input) in applying the Kalman filter model to improve the localization accuracy:

where $x_1$, $x_2$ are the coordinates of the sound source in a cartesian axis v is the velocity of the sound source, h is the heading angle of the sound source, and w is the angular velocity of the sound source.

In examples, the Kalman filter model takes results from the cross-convolution localization for a time frame as input, and returns a predicted location of the sound source at the corresponding time frame, with noise removed, when an initial position of the sound source is not known. The time frame may be associated with digital data from the microphone. For example, each time frame may contain $F_s$*n number of samples, where $F_s$ is a sampling rate and n is a time duration of a frame. Initial values of the state vector for purposes of applying the Kalman filter model may be determined based on one or more frames of the digital data.

To validate use of the Kalman filter model to improve the sound source localization, real time recordings are made by microphones of behind-the-ear hearing aids mounted on the test subject in the form of the anatomical model of the human being. The test subject is mounted on a rotating platform to simulate a sound source moving at constant turning rate. Non-directional ambient noise $n_t$ is then added to the HRTF received by the microphone of the behind-the-ear hearing aids to simulate different signal-to-noise ratio (SNR) cases.

Figure 7:
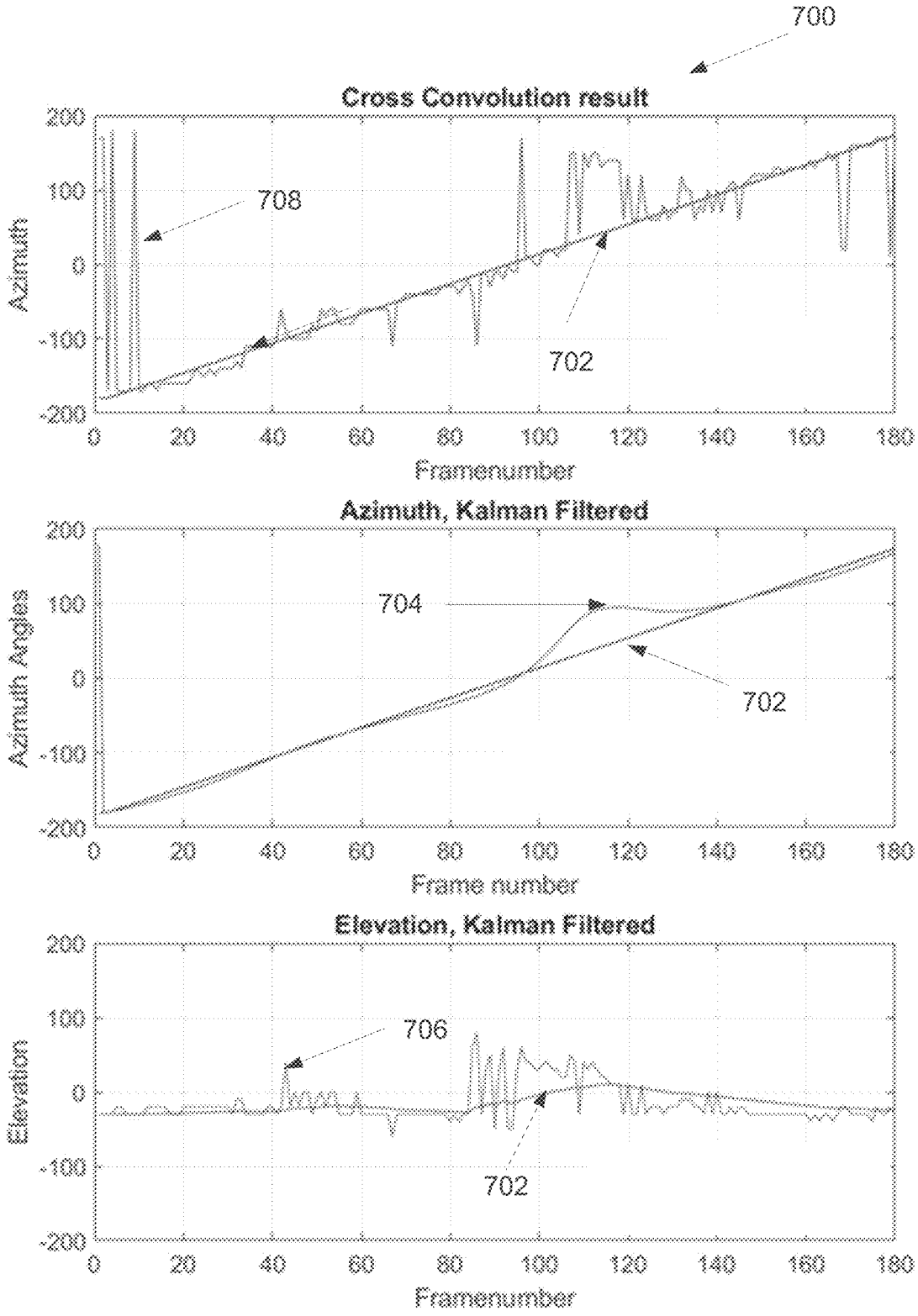
FIG. 7 shows an example comparison of a best estimate of the sound source location to a ground truth, in both azimuth and elevation, based on a Kalman filter model.

FIG. 7 shows an example comparison 700 of a best estimate of the sound source location to a ground truth 702, in terms of azimuth 704 and elevation 706, based on an estimate of position 708 indicated by the cross-convolution results. The turning rate in this example is 2 revolutions per minute (rpm). The Kalman filter model smooths results of the azimuth 704 and elevation 706 of the sound source, improving source localization.

Figure 8:
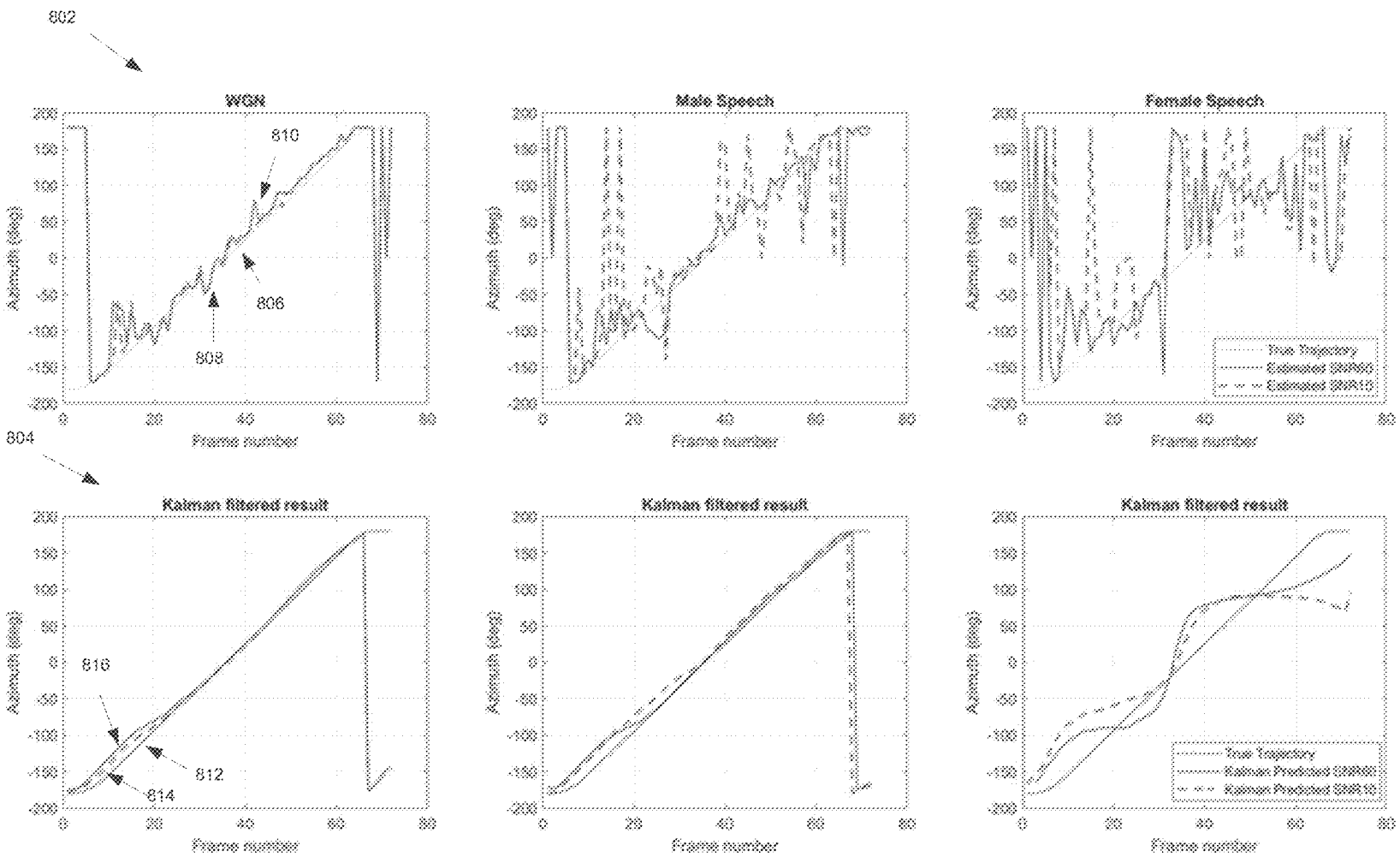
FIG. 8 shows an example of improving source localization for different source types, signal-to-noise, and turning rates of the sound source based on the Kalman filter model.

FIG. 8 shows an example improvement of source localization for different source types, signal-to-noise, and turning rates based on the Kalman filter model. The sound source may take a circular trajectory with a turning rate of 6 revolutions per minute (rpms). The sound source position before Kalman filtering is shown in plots 802 and the sound source position after Kalman filtering in plots 804 for this example sound source trajectory. Position estimates are further shown for the source types of white gaussian noise (WGN), a male speech, and a female speech with an SNR of 10 dB and 60 dB. Before Kalman filtering, line 806 indicates a true trajectory of the sound source, line 808 indicates an estimated trajectory with 10 dB of noise, and line 810 indicates an estimated trajectory with 60 dB of noise before the Kalman filtering. After Kalman filtering, line 812 indicates a true trajectory of the sound source, line 814 indicates an estimated trajectory with 10 dB of noise, and line 816 indicates an estimated trajectory with 60 dB of noise after the Kalman filtering. A mean trajectory error is shown as:

| SNR Level | WGN | Male Speech | Female Speech |
|---|---|---|---|
| SNR60 | 11.72 | 11.50 | 32.30 |
| SNR10 | 7.41 | 13.90 | 38.44 |

The Kalman filter model has minimal latency and is ideal for real-time application for determining the location of the sound source.

Example Apparatus

Figure 9:
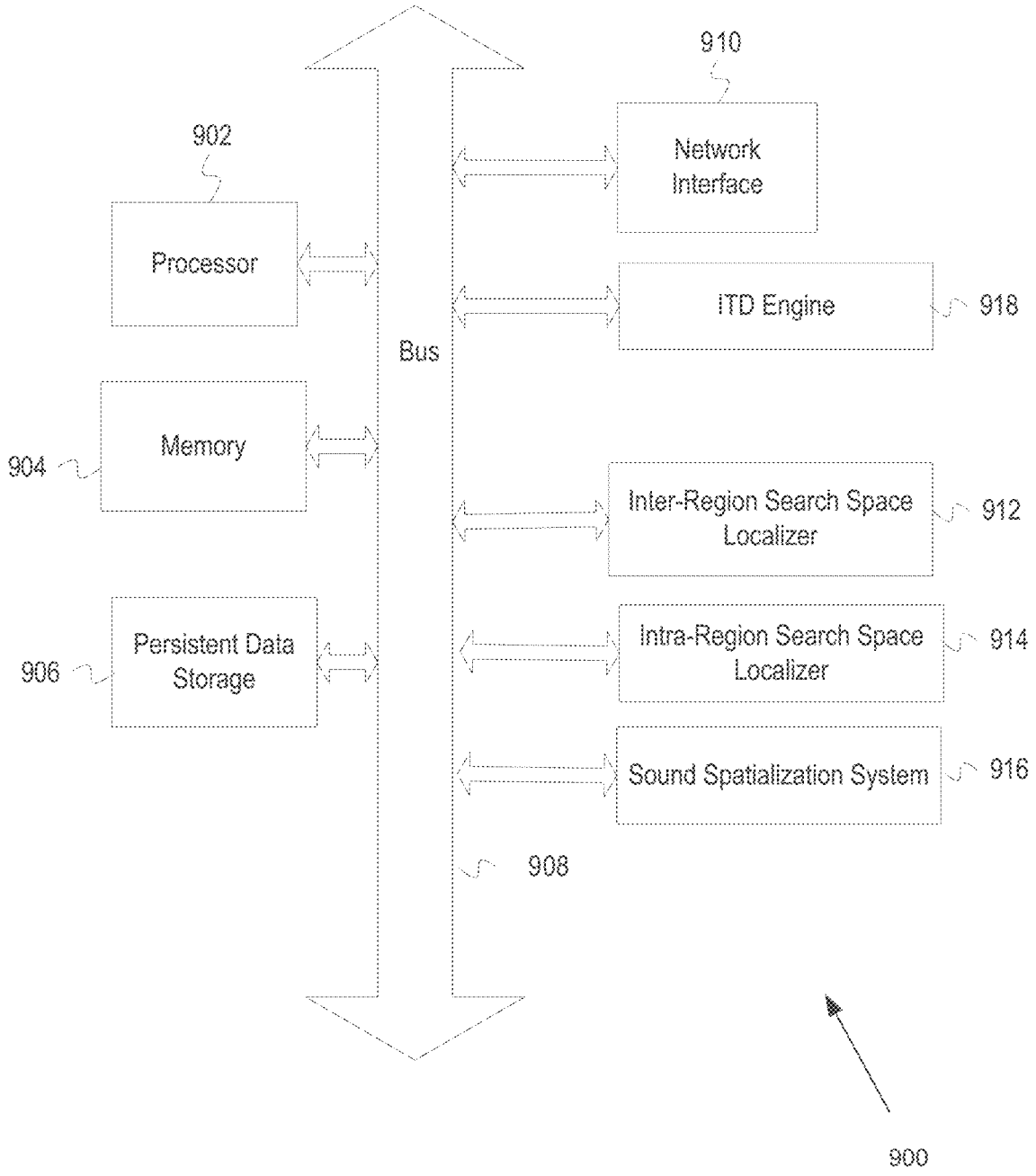
FIG. 9 is an example block diagram of an information handling system for determining the location of the sound source.

FIG. 9 is an example block diagram of apparatus 900 such as the information handling system 106 which performs functions associated with determining the location of a sound source. The apparatus 900 may be a computer in some examples which include hardware, software, and/or a combination of hardware and software for performing the functions.

The apparatus 900 includes a computing device such as a processor 902 (possibly including multiple processors, multiple cores, multiple nodes, and/or implementing multi-threading, etc.) and memory 904 such as system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more other possible realizations of non-transitory machine-readable media/medium.

The apparatus 900 may include persistent data storage 906 such as flash memory or a hard disk drive (HDD). The persistent data storage 906 may have the HRTF database and the PADD HRTFs associated with the microphone signals received from the microphones of the personal audio delivery device. The apparatus 900 also includes a bus 908 (e.g., PCI, ISA, PCI-Express) and a network interface 910 for receiving the PADD HRTFs to store in the persistent data storage 906.

The apparatus 900 may include the inter-region search space localizer 912 and intra-region search space localizer 914 for determining the location of the sound source. In some examples, the apparatus 900 may also have a sound spatialization system 916 to spatialize sound based on the sound source location indicated by the search space localizers. The apparatus 900 may also include the ITD engine 918 for determining an ITD associated with the in-ear HRTF and PADD HRTFs.

The apparatus 900 may implement any one of the previously described functionalities partially (or entirely) in hardware and/or software (e.g., computer code, program instructions, computer instructions, program code) stored on a non-transitory machine readable medium/media. In some instances, the software is executed by the processor 902. Further, realizations can include fewer or additional components not illustrated in FIG. 9 (e.g., video cards, audio cards, additional network interfaces, peripheral devices, etc.). The processor 902 and the memory 904 are coupled to the bus 908. Although illustrated as being coupled to the bus 908, the memory 904 can be coupled to the processor 902. Further, functions described as being performed on apparatus 900 taking the form of the computer located remotely from the personal audio delivery device may be performed on the personal audio delivery device.

The description above discloses, among other things, various example systems, methods, modules, apparatus, and articles of manufacture including, among other components, firmware and/or software executed on hardware. It is understood that such examples are merely illustrative and should not be considered as limiting. For example, it is contemplated that any or all of the firmware, hardware, modules, and/or software aspects or components can be embodied exclusively in hardware, exclusively in software, exclusively in firmware, or in any combination of hardware, software, and/or firmware. Accordingly, the examples provided are not the only way(s) to implement such systems, methods, apparatus, and/or articles of manufacture.

Additionally, references herein to "example" and/or "embodiment" means that a particular feature, structure, or characteristic described in connection with the example and/or embodiment can be included in at least one example and/or embodiment of an invention. The appearances of this phrase in various places in the specification are not necessarily all referring to the same example and/or embodiment, nor are separate or alternative examples and/or embodiments mutually exclusive of other examples and/or embodiments. As such, the example and/or embodiment described herein, explicitly and implicitly understood by one skilled in the art, can be combined with other examples and/or embodiments.

The specification is presented largely in terms of illustrative environments, systems, procedures, steps, logic blocks, processing, and other symbolic representations that directly or indirectly resemble the operations of data processing devices coupled to networks. These process descriptions and representations are typically used by those skilled in the art to most effectively convey the substance of their work to others skilled in the art. Numerous specific details are set forth to provide a thorough understanding of the present disclosure. However, it is understood to those skilled in the art that certain embodiments of the present disclosure can be practiced without certain, specific details. In other instances, well known methods, procedures, components, and circuitry have not been described in detail to avoid unnecessarily obscuring aspects of the embodiments. Accordingly, the scope of the present disclosure is defined by the appended claims rather than the forgoing description of embodiments.

When any of the appended claims are read to cover a purely software and/or firmware implementation, at least one of the elements in at least one example is hereby expressly defined to include a tangible, non-transitory medium such as a memory, DVD, CD, Blu-ray, and so on, storing the software and/or firmware.

EXAMPLE EMBODIMENTS

Example embodiments include the following:

Embodiment 1

A method comprising: measuring, based on a first microphone of a first earpiece of a personal audio delivery device, a first head related transfer function (HRTF) associated with a sound source; measuring, based on a second microphone of a second earpiece of the personal audio delivery device, a second HRTF associated with the sound source; determining an interaural time difference (ITD) based on the first HRTF and the second HRTF; determining that the sound source is located in a first region based on the interaural time difference; determining that the sound source is located in a second region within the first region based on the ITD of the first HRTF and the second HRTF and an ITD associated with third HRTFs for the second region; and determining a location of the sound source within the second region.

Embodiment 2

The method of Embodiment 1, further comprising applying a difference filter to the third HRTFs, wherein the difference filter adjusts for a difference in position of the first or second microphone and a position of a microphone associated with the third HRTFs; and wherein determining that the sound source is located in the second region based on the third HRTFs comprises determining that the sound source is located in the second region based on the third HRTFs adjusted by the difference filter.

Embodiment 3

The method of Embodiment 1 or 2, further comprising determining that the sound source is located in a third region within the first region based on frequencies of sound associated with the sound source; and wherein the second region is within the first region and the third region.

Embodiment 4

The method of any one of Embodiments 1 to 3, wherein the third region indicates whether the sound source is located in front, behind, above or below a listener.

Embodiment 5

The method of any one of Embodiments 1 to 4, wherein the third HRTFs are reference HRTFs determined by positioning a microphone at an entrance to an ear canal of a listener.

Embodiment 6

The method any one of Embodiments 1 to 5, wherein determining that the sound source is located in the second region comprises comparing the ITD of the first HRTF and the second HRTF to the ITD associated the third HRTFs.

Embodiment 7

The method of any one of Embodiments 1 to 6, wherein determining the location of the sound source within the second region comprises determining the location of the sound source based on a cross-convolutional based localization and applying a Kalman filter model to the determined location within the second region.

Embodiment 8

A non-transitory, machine-readable medium having instructions stored thereon that are executable by a computing device to perform operations comprising: measuring, based on a first microphone of a first earpiece of a personal audio delivery device, a first head related transfer function (HRTF) associated with a sound source; measuring, based on a second microphone of a second earpiece of the personal audio delivery device, a second HRTF associated with the sound source; determining an interaural time difference (ITD) based on the first HRTF and the second HRTF; determining that the sound source is located in a first region based on the interaural time difference; determining that the sound source is located in a second region within the first region based on the ITD of the first HRTF and the second HRTF and an ITD associated with third HRTFs for the second region; and determining a location of the sound source within the second region.

Embodiment 9

The machine-readable medium of Embodiment 8, further comprising instructions for applying a difference filter to the third HRTFs, wherein the difference filter adjusts for a difference in position of the first or second microphone and a position of a microphone associated with the third HRTFs; and wherein the instructions for determining that the sound source is located in the second region based on the third HRTFs comprises instructions for determining that the sound source is located in the second region based on the third HRTFs adjusted by the difference filter.

Embodiment 10

The machine-readable medium of Embodiment 8 or 9, further comprising instructions for determining that the sound source is located in a third region within the first region based on frequencies of sound associated with the sound source; and wherein the second region is within the first region and the third region.

Embodiment 11

The machine-readable medium of any one of Embodiments 8 to 10, wherein the third region indicates whether the sound source is located in front, behind, above or below a listener.

Embodiment 12

The machine-readable medium of any one of Embodiments 8 to 11, wherein the third HRTFs are reference HRTFs determined by positioning a microphone at an entrance to an ear canal of a listener.

Embodiment 13

The machine-readable medium of any one of Embodiments 8 to 12, wherein the instructions for determining that the sound source is located in the second region comprises instructions for comparing the ITD of the first HRTF and the second HRTF to the ITD associated with the third HRTFs.

Embodiment 14

The machine-readable medium of any one of Embodiments 8 to 13, wherein the instructions for determining the location of the sound source within the second region comprises instructions for determining the location of the sound source based on a cross-convolutional based localization and applying a Kalman filter model to the determined location within the second region.

Embodiment 15

A system comprising: a personal audio delivery device comprising a first microphone on a first earpiece of the personal audio delivery device and a second microphone on a second earpiece of the personal audio delivery device; a non-transitory, machine-readable medium having instructions stored thereon that are executable by a computing device to perform operations comprising: measuring, based on the first microphone of the first earpiece of the personal audio delivery device, a first head related transfer function (HRTF) associated with a sound source; measuring, based on the second microphone of the second earpiece of the personal audio delivery device, a second HRTF associated with the sound source; determining an interaural time difference (ITD) based on the first HRTF and the second HRTF; determining that the sound source is located in a first region based on the interaural time difference; determining that the sound source is located in a second region within the first region based on the ITD of the first HRTF and the second HRTF and an ITD associated with third HRTFs for the second region; and determining a location of the sound source within the second region.

Embodiment 16

The system of Embodiment 15, further comprising instructions for applying a difference filter to the third HRTFs, wherein the difference filter adjusts for a difference in position of the first or second microphone and a position of a microphone associated with the third HRTFs; and wherein the instructions for determining that the sound source is located in the second region based on the third HRTFs comprises instructions for determining that the sound source is located in the second region based on the third HRTFs adjusted by the difference filter.

Embodiment 17

The system of Embodiment 15 or 16, further comprising instructions for determining that the sound source is located in a third region within the first region based on frequencies of sound associated with the sound source; and wherein the second region is within the first region and the third region.

Embodiment 18

The system of any one of Embodiments 15 to 17, wherein the third region indicates whether the sound source is located in front, behind, above or below a listener.

Embodiment 19

The system of any one of Embodiments 15 to 18, wherein the one or more third HRTFs are reference HRTFs determined by positioning a microphone at an entrance to an ear canal of a listener.

Embodiment 20

The system of any one of Embodiments 15 to 19, wherein the instructions for determining that the sound source is located in the second region comprises instructions for comparing the ITD of the first HRTF and the second HRTF to the ITD associated with the third HRTFs.

We claim:

1. A method comprising:

measuring, based on a first microphone of a first earpiece of a personal audio delivery device, a first head related transfer function (HRTF) associated with a sound source;

measuring, based on a second microphone of a second earpiece of the personal audio delivery device, a second HRTF associated with the sound source;

determining an interaural time difference (ITD) based on the first HRTF and the second HRTF;

determining that the sound source is located in a first region based on the interaural time difference;

determining that the sound source is located in a second region within the first region based on the ITD of the first HRTF and the second HRTF and an ITD associated with third HRTFs for the second region; and determining a location of the sound source within the second region.

2. The method of claim 1, further comprising applying a difference filter to the third HRTFs, wherein the difference filter adjusts for a difference in position of the first or second microphone and a position of a microphone associated with the third HRTFs; and wherein determining that the sound source is located in the second region based on the third HRTFs comprises determining that the sound source is located in the second region based on the third HRTFs adjusted by the difference filter.

3. The method of claim 1, further comprising determining that the sound source is located in a third region within the first region based on frequencies of sound associated with the sound source; and wherein the second region is within the first region and the third region.

4. The method of claim 3, wherein the third region indicates whether the sound source is located in front, behind, above or below a listener.

5. The method of claim 1, wherein the third HRTFs are reference HRTFs determined by positioning a third microphone at an entrance to an ear canal of a listener.

6. The method of claim 1, wherein determining that the sound source is located in the second region comprises comparing the ITD of the first HRTF and the second HRTF to the ITD associated the third HRTFs.

7. The method of claim 1, wherein determining the location of the sound source within the second region comprises determining the location of the sound source based on a cross-convolutional based localization and applying a Kalman filter model to the determined location within the second region.

8. A non-transitory, machine-readable medium having instructions stored thereon that are executable by a computing device to perform operations comprising:

measuring, based on a first microphone of a first earpiece of a personal audio delivery device, a first head related transfer function (HRTF) associated with a sound source;

measuring, based on a second microphone of a second earpiece of the personal audio delivery device, a second HRTF associated with the sound source;

determining an interaural time difference (ITD) based on the first HRTF and the second HRTF;

determining that the sound source is located in a first region based on the interaural time difference;

determining that the sound source is located in a second region within the first region based on the ITD of the first HRTF and the second HRTF and an ITD associated with third HRTFs for the second region; and determining a location of the sound source within the second region.

9. The machine-readable medium of claim 8, further comprising instructions for applying a difference filter to the one or more third HRTFs, wherein the difference filter adjusts for a difference in position of the first or second microphone and a position of a microphone associated with the third HRTFs; and wherein the instructions for determining that the sound source is located in the second region based on the third HRTFs comprises instructions for determining that the sound source is located in the second region based on the third HRTFs adjusted by the difference filter.

10. The machine-readable medium of claim 8, further comprising instructions for determining that the sound source is located in a third region within the first region based on frequencies of sound associated with the sound source; and wherein the second region is within the first region and the third region.

11. The machine-readable medium of claim 10, wherein the third region indicates whether the sound source is located in front, behind, above or below a listener.

12. The machine-readable medium of claim 8, wherein the one or more third HRTFs are reference HRTFs determined by positioning a third microphone at an entrance to an ear canal of a listener.

13. The machine-readable medium of claim 8, wherein the instructions for determining that the sound source is located in the second region comprises instructions for comparing the ITD of the first HRTF and the second HRTF to the ITD associated with the third HRTFs.

14. The machine-readable medium of claim 8, wherein the instructions for determining the location of the sound source within the second region comprises instructions for determining the location of the sound source based on a cross-convolutional based localization and applying a Kalman filter model to the determined location within the second region.

15. A system comprising:

a personal audio delivery device comprising a first microphone on a first earpiece of the personal audio delivery device and a second microphone on a second earpiece of the personal audio delivery device;

a non-transitory, machine-readable medium having instructions stored thereon that are executable by a computing device to perform operations comprising:

measuring, based on the first microphone of the first earpiece of the personal audio delivery device, a first head related transfer function (HRTF) associated with a sound source;

measuring, based on the second microphone of the second earpiece of the personal audio delivery device, a second HRTF associated with the sound source;

determining an interaural time difference (ITD) based on the first HRTF and the second HRTF;

determining that the sound source is located in a first region based on the interaural time difference;

determining that the sound source is located in a second region within the first region based on the ITD of the first HRTF and the second HRTF and an ITD associated with third HRTFs for the second region; and determining a location of the sound source within the second region.

16. The system of claim 15, further comprising instructions for applying a difference filter to the third HRTFs, wherein the difference filter adjusts for a difference in position of the first or second microphone and a position of a microphone associated with the third HRTFs; and wherein the instructions for determining that the sound source is located in the second region based on the third HRTFs comprises instructions for determining that the sound source is located in the second region based on the third HRTFs adjusted by the difference filter.

17. The system of claim 15, further comprising instructions for determining that the sound source is located in a third region within the first region based on frequencies of sound associated with the sound source; and wherein the second region is within the first region and the third region.

18. The system of claim 17, wherein the third region indicates whether the sound source is located in front, behind, above or below a listener.

19. The system of claim 15, wherein the one or more third HRTFs are reference HRTFs determined by positioning a third microphone at an entrance to an ear canal of a listener.

20. The system of claim 15, wherein the instructions for determining that the sound source is located in the second region comprises instructions for comparing the ITD of the first HRTF and the second HRTF to the ITD associated with the third HRTFs.

* * * * *